US009371211B2

(12) United States Patent
Klumpers et al.

(10) Patent No.: US 9,371,211 B2
(45) Date of Patent: Jun. 21, 2016

(54) DRIVE FRAME FOR AN ELEVATOR INSTALLATION

(75) Inventors: Constantin Klumpers, Reinach (CH); Alfonso Lahuerta, Zaragoza (ES)

(73) Assignee: Inventio AG, Hergiswil (CH)

( * ) Notice: Subject to any disclaimer, the term of this patent is extended or adjusted under 35 U.S.C. 154(b) by 639 days.

(21) Appl. No.: 13/484,458

(22) Filed: May 31, 2012

(65) Prior Publication Data

US 2012/0305335 A1 Dec. 6, 2012

(30) Foreign Application Priority Data

May 31, 2011 (EP) ..... 11168154

(51) Int. Cl.
*B66B 11/08* (2006.01)
*B66B 11/00* (2006.01)
*B66B 19/00* (2006.01)

(52) U.S. Cl.
CPC ..... *B66B 11/00* (2013.01); *B66B 11/0035* (2013.01); *B66B 19/007* (2013.01)

(58) Field of Classification Search
CPC .... B66B 11/00; B66B 19/007; B66B 11/005; B66B 17/02; B66B 19/04
USPC ..... 187/266
See application file for complete search history.

(56) References Cited

U.S. PATENT DOCUMENTS

| | | | | | |
|---|---|---|---|---|---|
| 611,311 | A * | 9/1898 | Behr | ..... | 242/476.7 |
| 5,957,242 | A * | 9/1999 | Suter et al. | ..... | 187/266 |
| 7,083,026 | B2 * | 8/2006 | Cholinski et al. | ..... | 187/266 |
| 2008/0006486 | A1 * | 1/2008 | Fischer | ..... | 187/393 |
| 2011/0278098 | A1 * | 11/2011 | Ketonen et al. | ..... | 187/266 |

FOREIGN PATENT DOCUMENTS

| | | | | | |
|---|---|---|---|---|---|
| EP | 0763495 | A1 | | 3/1997 | |
| EP | 1338546 | A1 | | 8/2003 | |
| EP | 2082983 | A1 | | 7/2009 | |
| JP | 53145244 | A | * | 12/1978 | ..... B66B 11/08 |
| JP | 54013153 | A | * | 1/1979 | ..... B66B 11/08 |
| JP | 06135666 | A | * | 5/1994 | ..... B66B 11/04 |
| JP | 2007204238 | A | * | 8/2007 | |
| WO | 2006/010785 | A1 | | 2/2006 | |
| WO | WO 2011051559 | A1 | * | 5/2011 | |

* cited by examiner

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

An elevator installation comprises a drive frame and a drive unit, wherein a support element couples an elevator cage with a counterweight, wherein a drive roller and a spacer roller are mounted at the drive frame on a mounting device associated therewith, wherein the support element is guided over the spacer roller of the drive roller, wherein at least one of the mounting devices is fixable to the drive frame at at least two positions so that a horizontal support element spacing is thereby variable and wherein a portion of the support element between the drive roller and the spacer roller is substantially linear.

14 Claims, 4 Drawing Sheets

DRIVE FRAME FOR AN ELEVATOR INSTALLATION

CROSS-REFERENCE TO RELATED APPLICATION

This application claims priority to European Patent Application No. 11168154.0, filed May 31, 2011, which is incorporated herein by reference.

FIELD

The disclosure relates to a drive frame for an elevator installation.

BACKGROUND

Elevator installations usually comprise an elevator cage, a counterweight, a drive unit, a drive roller and a support element. The support element couples the elevator cage and the counterweight. The support element can be guided in an upper region of the elevator installation over the drive roller. In that case it is usual to let segments of the support element, which lead from the drive roller on the one hand to a suspension at the elevator cage and on the other hand to a suspension at the counterweight, extend almost parallel. For this purpose, depending on the spacing of the suspensions of the support element at the elevator cage and the counterweight a spacer roller can be arranged near the drive roller. A spacing of these two parallel extending segments of the support element is termed support element spacing. Within the scope of modernizations, drive units with respectively associated drive roller and optional spacer roller can be replaced by drive frames on which these functional units are mounted. The drive frames can be so designed that the support element spacing can be varied. It is thus possible to use drive frames of the same form of construction in elevator installations which differ from one another due to different support element spacings. In that case it can be important that in a sufficiently high degree of looping around of the drive roller by the support element is present in order to help ensure adequate traction between drive roller and support element.

SUMMARY

At least some embodiments comprise an elevator installation with a drive frame and a drive unit, wherein a support element couples an elevator cage with a counterweight, wherein a drive roller and a spacer roller are mounted at the drive frame on a mounting device associated therewith, wherein the support element is guided over the spacer roller and a drive roller, wherein at least one of the mounting devices is fixable to the drive frame at at least two positions so that a horizontal support element spacing is thereby able to be changed and wherein an entire course of the support element between the drive roller and the spacer roller is substantially linear. The horizontal support element spacing can be changed by a possible variable fixing of the mounting devices on the drive frame at several positions.

In at least some embodiments, regardless of the support element spacing, a constant and sufficiently high looping around of the drive roller by the support element leads to an improved mode of operation. In some cases, movable parts are reduced. Thus, the maintenance outlay and also the installation outlay can be reduced. Subassemblies which are fixable on the drive frame at different positions for variation of the support element spacing are reduced in their size. Avoidance, which is possible in this manner, of reverse bending of the support element can also increase the service life of the support element.

In some embodiments, the mounting device for the spacer roller is fixable to the drive frame at at least two positions. An independently variable capability of fixing of the mounting device for the spacer roller can be of advantage, so that loading of the drive frame can be improved. Release and re-fixing for the purpose of a changed positioning of the mounting device for the spacer roller at the drive frame can be performed in simple manner because the spacer roller in the absence of the support element is not coupled with the drive.

In some embodiments the at least two positions for a fixing of the at least one mounting device are arranged along a straight line substantially parallel to the linear course of the support element. It is thus possible independently of the selected position of the fixing to design a course of the support element to be identical. The support element thus always forms the same angle at deflecting points in the region of the drive frame regardless of the drive element spacing. A drive frame can thus be adapted to many or all conditions.

In some embodiments the at least one mounting device, the position of which on the drive frame is variable, is fixed to the drive frame by screw connections or friction-locking connections. Thus, the mounting devices can be rapidly released from or fixed to the drive frame by an engineer or a service specialist. A support element spacing can be adjusted on site in the elevator installation.

In some embodiments the two segments of the support element, which are arranged directly at the drive roller and extend substantially linearly, form an acute angle. Thus, a high degree of looping around or an obtuse looping-around angle of the support element around the drive roller can be achieved.

In some embodiments this acute angle has a size within a range of 10° to 80°. Through such a limitation a sufficiently high looping angle is ensured without the drive frame exceeding a height appropriate to its purpose.

In further embodiments, at least one end of the support element is fixed to the drive frame by means of a fixing point device, wherein the fixing point device is arranged at one of the mounting devices. In some embodiments a measuring device for determination of a measurement size is arranged at the fixing point device. In some embodiments a drive unit is arranged at the drive frame. Through the aforesaid measures a requisite need by components of the elevator installation for space can be reduced. Through the arrangement of the respective fixing point device at the mounting device associated therewith it is possible to help ensure, notwithstanding a variable support element spacing, that the support element extends substantially perpendicularly from the drive frame, i.e. not only from the drive roller or spacer roller, but also from the respective fixing point, to the elevator cage or to the counterweight. The fixing point device and/or the drive unit can be already mounted in finished state on the drive frame during production in the factory. The measuring device can be premounted at this fixing point device. This can lead to a saving of assembly and calibration time.

BRIEF DESCRIPTION OF THE DRAWINGS

The disclosure is explained in more detail in the following by way of figures, in which.

DETAILED DESCRIPTION

Figure 1:
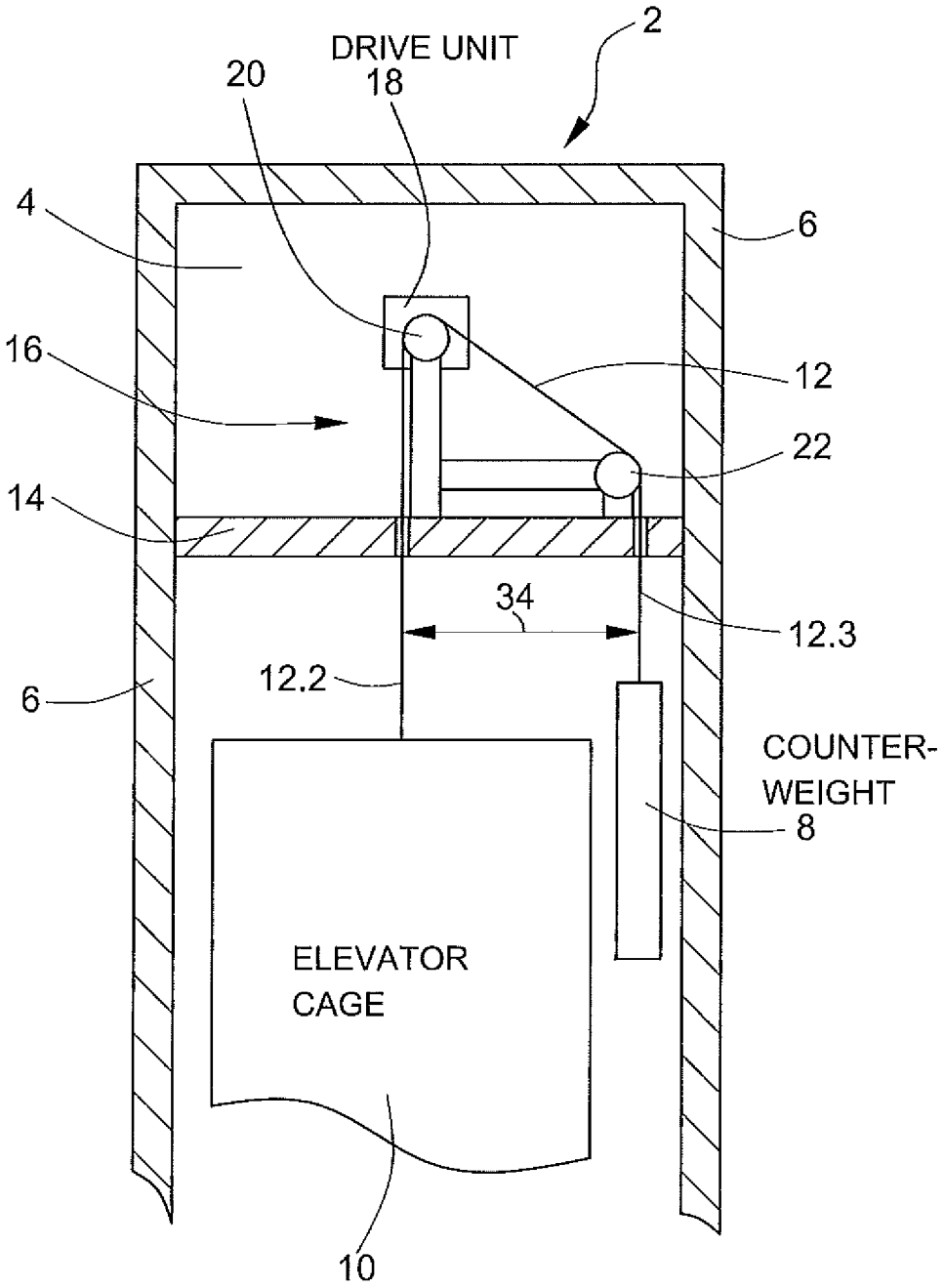
FIG. 1 shows an elevator installation with a drive frame.

FIG. 1 shows an elevator installation 2 in an elevator shaft 4. The elevator shaft 4 is bounded by shaft walls 6. The elevator installation 2 comprises an elevator cage 10 and a counterweight 8. The elevator cage 10 and the counterweight 8 are suspended at a support element 12. The support element 12 is guided in an upper region of the elevator shaft 4 over a drive roller 20 and a spacer roller 22. The drive roller 20 is coupled with a drive unit 18 and operatively connected therewith. The drive roller 20 and the spacer roller 22 are mounted at a drive frame 16. For example, the drive frame 16 can be fixed on a load surface 14. A segment 12.2, which is at the cage side and runs from the drive frame 16 to the elevator cage 10, of the support element 12 has a spacing from the segment 12.3, which is at the counterweight side and which runs from the drive frame 16 to the counterweight 8, of the support element 12. This spacing is termed carrier element spacing 34. The carrier element spacing 34 can be of different sizes in different elevator installations.

In the case of modernization of existing elevator installations there is the question of modernization of the drive unit, the drive roller and the spacer roller. In addition, it is at least sometimes desired to use drive frames of the same mode of construction and size in different elevator installations to be modernized.

Figure 2:
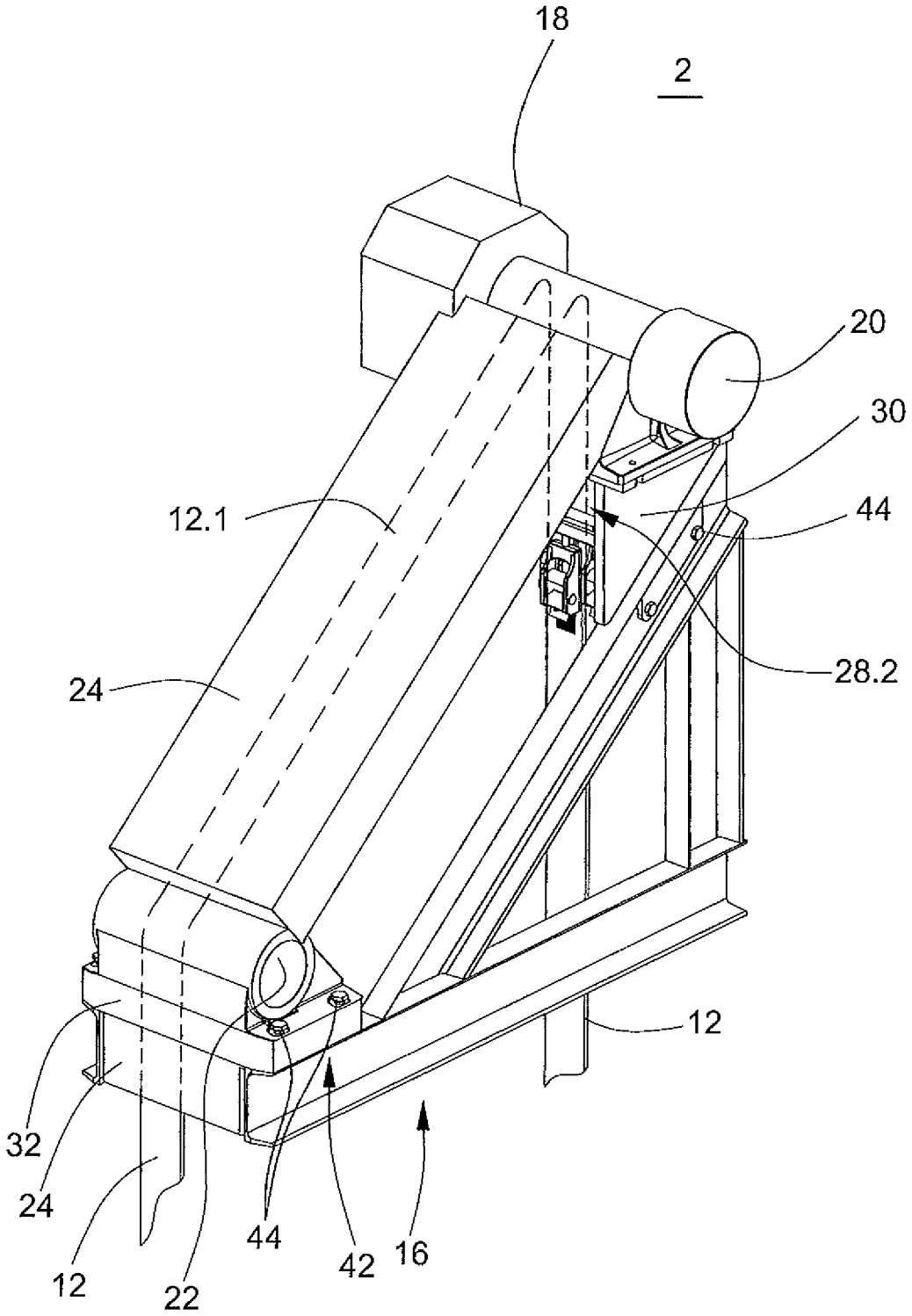
FIG. 2 shows an exemplary embodiment of a drive frame in a perspective illustration with elements arranged thereon.
Figure 3:
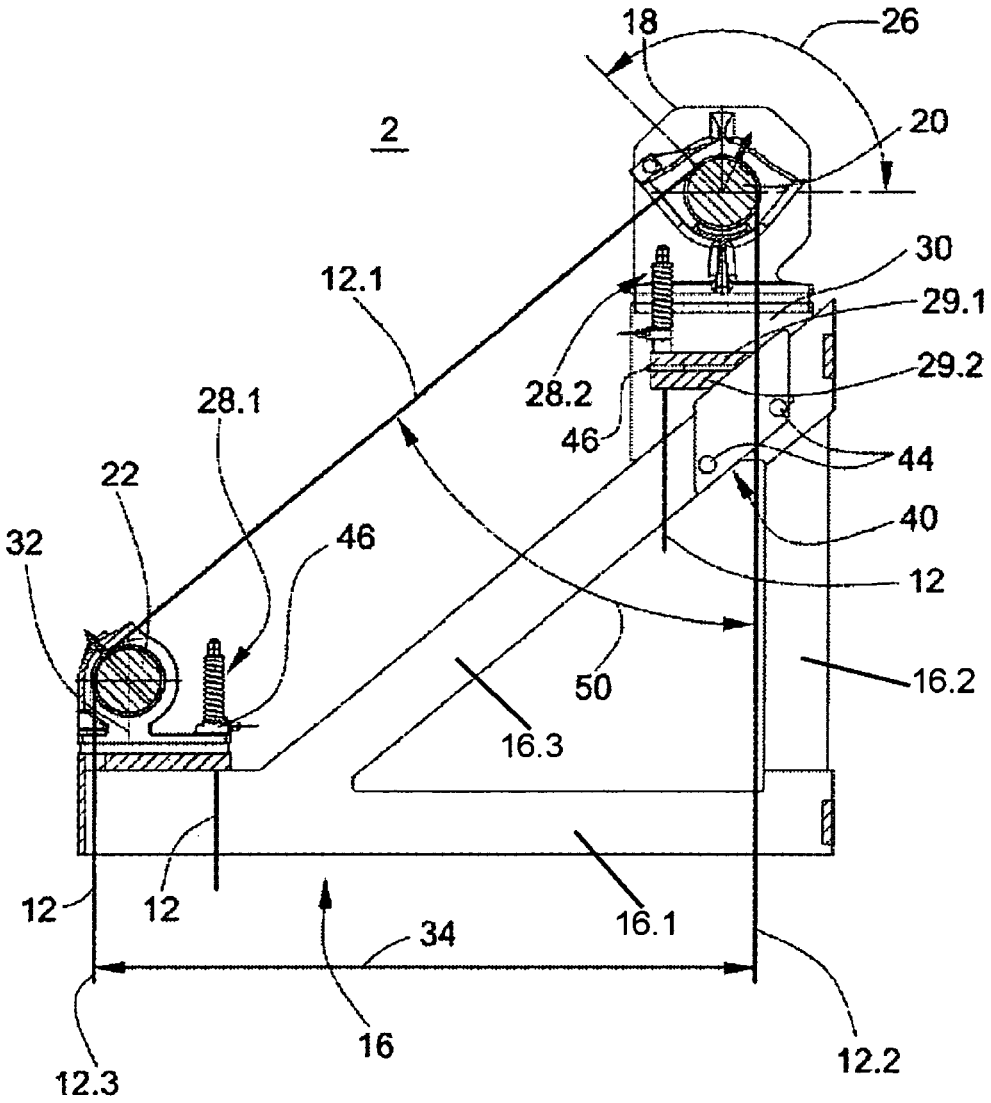
FIG. 3 shows a drive frame according to FIG. 2 in a side view with elements arranged thereon.

FIG. 2 and FIG. 3 show an exemplary embodiment of a drive frame 16 with elements arranged thereon. The drive frame 16 is arranged in an upper region of the elevator installation 2 and represents a load-bearing structure. A projection of the drive frame 16, according to the side view shown in FIG. 3, has a shape similar to a right-angled triangle. Fastened to the drive frame 16 are mounting devices 30, 32 which are arranged near the acute-angled corner points of this projected right-angled triangle. These mounting devices are a drive roller mounting unit 30 and a spacer roller mounting unit 32. A drive roller 20 is mounted on the drive roller mounting unit 30. A drive unit 18 can be fastened to the drive roller mounting unit 30. The drive unit 18 is operatively connected with the drive roller 20. A spacer roller 22 is mounted on the spacer roller mounting unit 32. A support element 12, which is coupled to a counterweight suspended thereat and an elevator cage suspended thereat is guided over the drive roller 20 and over the spacer roller 22. The counterweight and the elevator cage are not illustrated. The support element 12 extends upwardly from the elevator cage and is deflected by the drive roller 20 and the spacer roller 22 downwardly to the counterweight. The course of a first segment 12.1 of the support element 12 from the drive roller 20 to the spacer roller 22 is substantially linear and is inclined. A fixing point device 28.2 can be arranged at the drive frame 16 at the drive roller side. The drive roller mounting unit 30 can be fastened to the drive frame 16 by means of screw connections 44. Use of friction-locking connections is a further possibility of fixing the mounting devices 30, 32 on the drive frame 16, the position of which on the drive frame 16 is variable.

FIG. 2 shows the drive frame 16 in a perspective view. The drive frame 16 can additionally have spacer roller fixing bores 42 in order to fasten the spacer roller mounting unit 32 to the drive frame 16. The spacer roller mounting unit 32 can thus be fastened to the drive frame 16 by screw connections 44. Alternatively, the spacer roller mounting unit 32 can also be fastened to the drive frame 16 by other known fastening elements or fastening methods. The support element 12 can be partly covered by covers 24.

FIG. 3 shows the drive frame 16 in a side view. The drive frame 16 has a horizontally extending base portion 16.1 adapted to extend substantially parallel to the load surface 14 on which the drive frame is affixed. The drive frame 16 includes a pair of arms 16.2, 16.3 each having one end attached to the base portion 16.1 and an opposite end, the opposite ends being attached together. The base portion 16.1 and the arms 16.2, 16.3 form the right-angled triangle shape of the drive frame 16. A segment 12.2 of the support element 12 at the cage side runs substantially vertically from the elevator cage to the drive roller 20. A segment 12.3 of the support element 12 at the counterweight side similarly runs substantially vertically from the counterweight to the spacer roller 22. A support element spacing 34 corresponds with the distance between the segment 12.2 of the support element 12 at the cage side and the segment 12.3 of the support element 12 at the counterweight side. The substantially rectilinear course of the first segment 12.1 of the support element 12 forms an acute angle 50 with respect to the segment 12.2 of the support element 12 at the cage side. The two segments 12.1, 12.2 are arranged directly at the drive roller 20. The acute angle 50 of the support element 12 at the drive roller 20 leads to a looping-around of the support element 12 at the drive roller 20. The looping is characterized by the looping angle 26 which is obtuse in correspondence with the acute angle 50. The looping angle 26 substantially corresponds with an angle of 180° less the acute angle 50. The angle 180° corresponds with half the round angle. The acute angle 50 possibly lies in a range between approximately 10° and approximately 80°. The consequence is a sufficiently high looping angle 26 and a limitation of the height of the drive frame 16 to a reasonable amount.

The drive frame 16 can have drive roller fixing bores 40. These drive roller fixing bores 40 are provided in order to be able to fasten the drive roller mounting unit 30 on the drive frame 16 by means of the screw connections 44. The drive roller fixing bores 40 are realized in multiple form so that the drive roller mounting unit 30 can be fastened on the drive frame 16 at different positions. The positions extend along a straight line arranged substantially parallel to the linear course of the support element 12, i.e. the first segment 12.1 thereof. The drive roller mounting unit 30 can alternatively be fastened to the drive frame 16 by other fastening elements or fastening methods. Thus, the drive roller mounting unit 30 can be fastened on the drive frame 16 in different positions without the looping angle 26 changing as a result. A selective fastening of the drive roller mounting unit 30 results in a variability of the support element spacing 34. A constant looping angle 26 of the support element 12 at the drive roller 20 with simultaneous variability of the support element spacing 34 in different elevator installations can allow for a definable mode of operation.

A fixing point device 28.1 can be fastened to the drive flame 16 at the spacer roller side. The fixing point devices 28.1, 28.2 are provided for the purpose of fixing one of the ends of the support element 12 in the elevator installation 2. In order that the segments of the support element run substantially vertically from the elevator cage or the counterweight to the drive frame 16 the fixing point devices 28.1, 28.2 are arranged at the mounting devices 30, 32. If the support element spacing 34 in accordance with the drive frame 16 is changed, this substantially vertical course is unaffected by that. As illustrated in FIG. 3, a measuring device 46 for determining a physical magnitude can be arranged at at least one of the fixing point devices 28.1, 28.2. A measuring device 46 can be arranged between two fixing point plates 29.1, 29.2, the spacing or relative movements of which with respect to one another are a measure for the physical magnitude to be determined. For example, this measuring device 46 is a load measuring device or a support element test device.

In at least some embodiments, the elevator cage and the counterweight of the elevator installation 2 described in FIGS. 2 and 3 can be interchanged.

Figure 4:
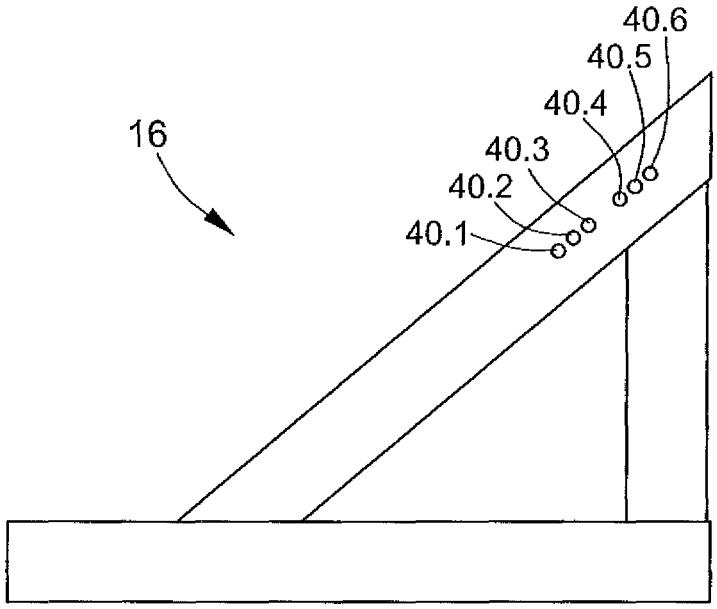
FIG. 4 shows a drive frame according to FIG. 2 in a side view.

FIG. 4 shows a drive frame 16 according to the previous FIGS. 2 and 3 in a side view. Drive roller fixing bores 40.1, 40.2, 40.3, 40.4, 40.5, 40.6, which allow fastening of a drive roller mounting unit at several positions, in the drive frame 16 are illustrated. These positions extend along a straight line arranged substantially parallel to the linear course of a support element between a drive roller and a spacer roller. The support element, drive roller and spacer roller as well as constructional features for fastening of a spacer roller mounting unit are not illustrated in FIG. 4.

Figure 5:
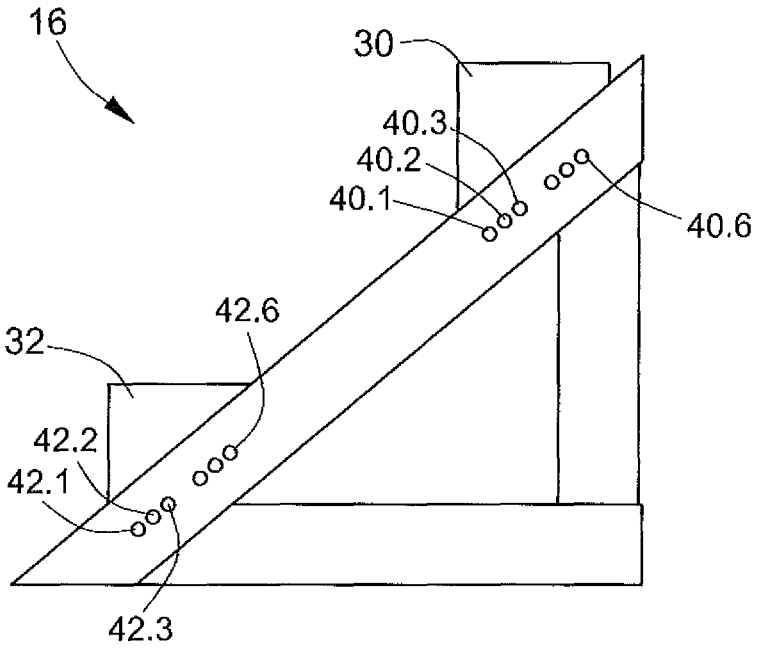
FIG. 5 shows a further embodiment of a drive frame in a side view.

FIG. 5 shows a further embodiment of a drive frame 16 in a side view. At least one drive roller fixing bore 40.1, 40.2, 40.3, 40.6 is present, which permits fastening of a drive roller mounting unit 30 on at least one position by means of fastening elements, for example a screw connection. At least one spacer roller fixing bore 42.1, 42.2, 42.3, 42.6 is also present, which in turn enables fastening of a spacer roller mounting unit 32. This spacer roller mounting unit 32 can be fixed by means of screw connections to the drive frame 16 at at least one position in correspondence with this at least one spacer roller fixing bore 42.1, 42.2, 42.3, 42.6. In some embodiments, the spacer roller mounting unit 32 or the drive roller mounting unit 30 is fixable at at least two positions of the drive frame.

One of ordinary skill in the art will recognize from the preceding FIGS. 2 to 5 and the descriptions thereof that the mounting devices 30, 32 for the drive roller and the spacer roller together with the respectively associated elements 18, 20, 22 can be interchanged at the drive frame 16.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An elevator installation, comprising:

a drive frame, the drive frame configured as a triangle having a horizontally extending base portion adapted to continuously extend between two vertices of the triangle substantially parallel to a load surface on which the drive frame is affixed;

a drive unit;

an elevator cage;

a counterweight;

a support element coupled to the elevator cage and the counterweight;

a drive roller, the drive roller being mounted at the drive frame on a first mounting device;

a spacer roller, the spacer roller being mounted at the drive frame on a second mounting device, the support element being guided over the spacer roller and the drive roller, a first segment of the support element between the spacer roller and the drive roller being substantially linear, the first mounting device or the second mounting device being fixable to the drive frame at two or more positions to provide a variable spacing between the first mounting device and second mounting device, the two or more positions being arranged along a line substantially parallel to the first segment of the support element between the spacer roller and the drive roller; and the support element comprising the first segment and a second segment arranged at the drive roller and extending substantially linearly to form an acute angle between the segments.

2. The elevator installation of claim 1, the second mounting device being fixable to the drive frame at the two or more positions.

3. The elevator installation of claim 1, the first mounting device or second mounting device being fixed to the drive frame by screw connections.

4. The elevator installation of claim 1, the acute angle being between 10 degrees and 80 degrees.

5. The elevator installation of claim 1, the support element having an end fixed to the drive frame by a fixing point device arranged at the first mounting device or second mounting device.

6. The elevator installation of claim 5, further comprising a measuring device arranged at the fixing point device.

7. The elevator installation of claim 1, the drive unit being fastened to the drive frame.

8. The elevator installation of claim 1, wherein the drive frame is configured as a right-angled triangle.

9. The elevator installation of claim 1, wherein the first mounting device is arranged proximate to an acute-angled corner point of the drive frame.

10. The elevator installation of claim 1, wherein the second mounting device is arranged proximate to an acute-angled corner point of the drive frame.

11. The elevator installation of claim 1, wherein the drive frame is configured as a right-angled triangle, the first mounting device is arranged proximate to an acute-angled corner point of the drive frame, and the second mounting device is arranged proximate to another acute-angled corner point of the drive frame.

12. The elevator installation of claim 1, wherein the first mounting device and the second mounting device are each fixable to the drive frame at two or more positions to provide a variable spacing between the first mounting device and second mounting device, the two or more positions being arranged along a line substantially parallel to the first segment of the support element between the spacer roller and the drive roller.

13. The elevator installation of claim 1, wherein the drive frame includes a pair of arms each having one end attached to the base portion and an opposite end, the opposite ends being attached together.

14. The elevator installation of claim 1, wherein the drive frame triangle has fixed angles.

* * * * *